US008777768B2

(12) United States Patent
Schoppe et al.

(10) Patent No.: US 8,777,768 B2
(45) Date of Patent: Jul. 15, 2014

(54) GOLF FLAGSTICK WITH CAPPED FERRULE

(75) Inventors: Terry L. Schoppe, Cedar Falls, IA (US); Matthew L. Hurley, Cedar Falls, IA (US)

(73) Assignee: Standard Golf Company, Cedar Falls, IA (US)

( * ) Notice: Subject to any disclaimer, the term of this patent is extended or adjusted under 35 U.S.C. 154(b) by 235 days.

(21) Appl. No.: 13/008,481

(22) Filed: Jan. 18, 2011

(65) Prior Publication Data

US 2012/0184387 A1 Jul. 19, 2012

(51) Int. Cl.
*A63B 57/00* (2006.01)

(52) U.S. Cl.
CPC ..... *A63B 57/0056* (2013.01); *A63B 2209/00* (2013.01)
USPC ..... 473/176

(58) Field of Classification Search
USPC ..... 473/176–178; 116/173, 174; 264/297.2, 264/328.1
See application file for complete search history.

(56) References Cited

U.S. PATENT DOCUMENTS

| | | | | | |
|---|---|---|---|---|---|
| 1,115,937 | A * | 11/1914 | Hinckley | ..... | 473/176 |
| 3,348,797 | A * | 10/1967 | Turbyfill | ..... | 248/539 |
| 5,451,045 | A * | 9/1995 | Garske | ..... | 473/176 |
| 6,478,687 | B1 * | 11/2002 | Colonello | ..... | 473/175 |
| 6,939,239 | B1 * | 9/2005 | Ash | ..... | 473/176 |
| 7,033,280 | B2 * | 4/2006 | Hottle et al. | ..... | 473/176 |
| 2002/0198059 | A1 * | 12/2002 | Gilmour | ..... | 473/176 |
| 2003/0096659 | A1 * | 5/2003 | Webb | ..... | 473/174 |
| 2009/0137331 | A1 * | 5/2009 | Hansen | ..... | 473/176 |
| 2011/0086719 | A1 * | 4/2011 | Long | ..... | 473/176 |
| 2012/0028725 | A1 * | 2/2012 | Priegel | ..... | 473/176 |

* cited by examiner

*Primary Examiner* — Mark Graham
(74) *Attorney, Agent, or Firm* — McKee, Voorhees & Sease, P.L.C.

(57) ABSTRACT

A golf flagstick is provided with a metal ferrule having a cap. The cap is softer than the metal body of the ferrule. The cap reduces wear and tear on the golf cup into which it is placed. The cap may be applied to the metal ferrule by over molding.

18 Claims, 7 Drawing Sheets

GOLF FLAGSTICK WITH CAPPED FERRULE

FIELD OF THE INVENTION

The present invention relates generally to golf flagsticks and more particularly to the ferrules used provided at the lower end of the flagsticks.

BACKGROUND OF THE INVENTION

Golf flagsticks are used to provide a visual indicator of a location of a golf hole. Most commonly they are provided within a cup in the hole on a golf green. They may also be provided as targets on a practice range, or within cups provided in holes on a practice putting green. Typically the flagstick will include an elongated pole or other flagstick body made of metal or fiberglass. A cloth flag or other visual indicator is generally attached at or near the top of the pole. The lower end of the flagstick is adapted to be inserted within a cup provided within a hole cut into the ground, typically into a putting green. To this end, the lower end of the flagstick is commonly provided with a ferrule that is adapted to fit within a socket provided in the center of the cup. The ferrule at the lower end of the flagstick can be inserted into the socket to retain the flagstick in the hole in a generally upright condition.

Most commonly, the ferrule is formed from aluminum or other hard metal. The metal ferrule can damage the cup through repeated use as it contacts and bangs against the cup, particularly the top portions of the cup and the area of the cup directly adjacent the socket into which the ferrule is received. The repeated striking of the ferrule against the various portions of the cup can cause scratches, mars, and other blemishes, and can cause painted surfaces to have the paint rubbed off. These blemishes in the cup can be aesthetically displeasing, and can lead to oxidation or other deterioration of the cup.

Substituting a plastic ferrule for a metal ferrule has not been found to be a completely satisfactory solution. The plastic ferrules have not been as durable as the metal ferrules. Additionally, the plastic ferrules are more susceptible to getting stuck in the socket within the cup when sand, dirt, or other contaminants get lodged between the ferrule and the socket of the cup.

It is an objective of the present invention to provide an improved ferrule for the lower end of the golf flagstick.

It is another objective of the present invention to provide an improved golf flagstick.

It is yet another objective of the present invention to provide an improved golf flagstick that includes a plastic-capped metal ferrule.

It is another objective of the present invention to provide a golf flagstick that does less damage to golf cups than golf sticks that utilize standard metal ferrules.

It is another objective of the present invention to provide a method for forming a cap on a metal ferrule for a golf flagstick.

These and other objects and features of the present invention will be apparent to those skilled in the art. The present invention is not to be limited to or by these objects, and the single embodiment need provide each and every objective listed.

SUMMARY OF THE INVENTION

According to one embodiment, the present invention is a ferrule for a golf flagstick that includes a metal body shaped for insertion within a socket of a golf cup. The metal body has a first end for attachment with a flagstick body and second end opposite from the first end for insertion into the socket. A cap covers and protects at least a portion of the second end of the metal body. The cap may be over molded onto the metal body. The metal body may include a retaining structure in engagement with the cap to hold the cap in place against the metal body. The retaining structure may be a circumferential groove. The material used to form the cap may have a hardness less than that of a golf cup. The material used to form the cap may be plastic or ultra high molecular weight polyethylene. The metal body may be formed from aluminum.

According to another embodiment, the present invention is a golf flagstick that includes a flagstick body and a metal ferrule body attached to the flagstick body. The metal ferrule body is shaped for insertion within a golf cup. The metal ferrule body has a first end and a second end opposite from the first end. The first end of the metal ferrule body is connected to the flagstick body. A cap covers and protects at least a portion of the second end of the metal ferrule body. The cap may be over molded onto the metal ferrule body. The metal ferrule body may include a retaining structure in engagement with the cap to hold the cap in place against the metal ferrule body. The retaining structure may comprise at least one circumferential groove. The material used to form the cap may have a hardness less than that of a golf cup including plastic or ultra high molecular weight polyethylene. A passage may be formed in the second end of the metal body for receipt of the flagstick body. The metal ferrule body may be formed from aluminum.

According to yet another embodiment, the present invention is a method for forming a plastic-capped metal ferrule for a golf flagstick. A metal body shaped for insertion within a socket of a golf cup is provided. The body has a first end for attachment with the flagstick body and a second end opposite from the first end for insertion into the socket. A mold cavity is provided. At least the second end of the metal body is positioned within the mold cavity and plastic is injected into the mold cavity. The injected plastic is allowed to at least partially harden into a cap covering at least a portion of the second end of the metal body to form a plastic-capped metal ferrule. The plastic-capped metal ferrule is removed from the mold cavity.

DETAILED DESCRIPTION OF THE PREFERRED EMBODIMENTS

The present invention will be described as it applies to its preferred embodiment. It is not intended that the present invention be limited to the described embodiment or the embodiments shown in the foregoing figures. It is intended that the invention covers all alternatives, modifications, and equivalents that may be included within the spirit and scope of the invention.

Figure 1:
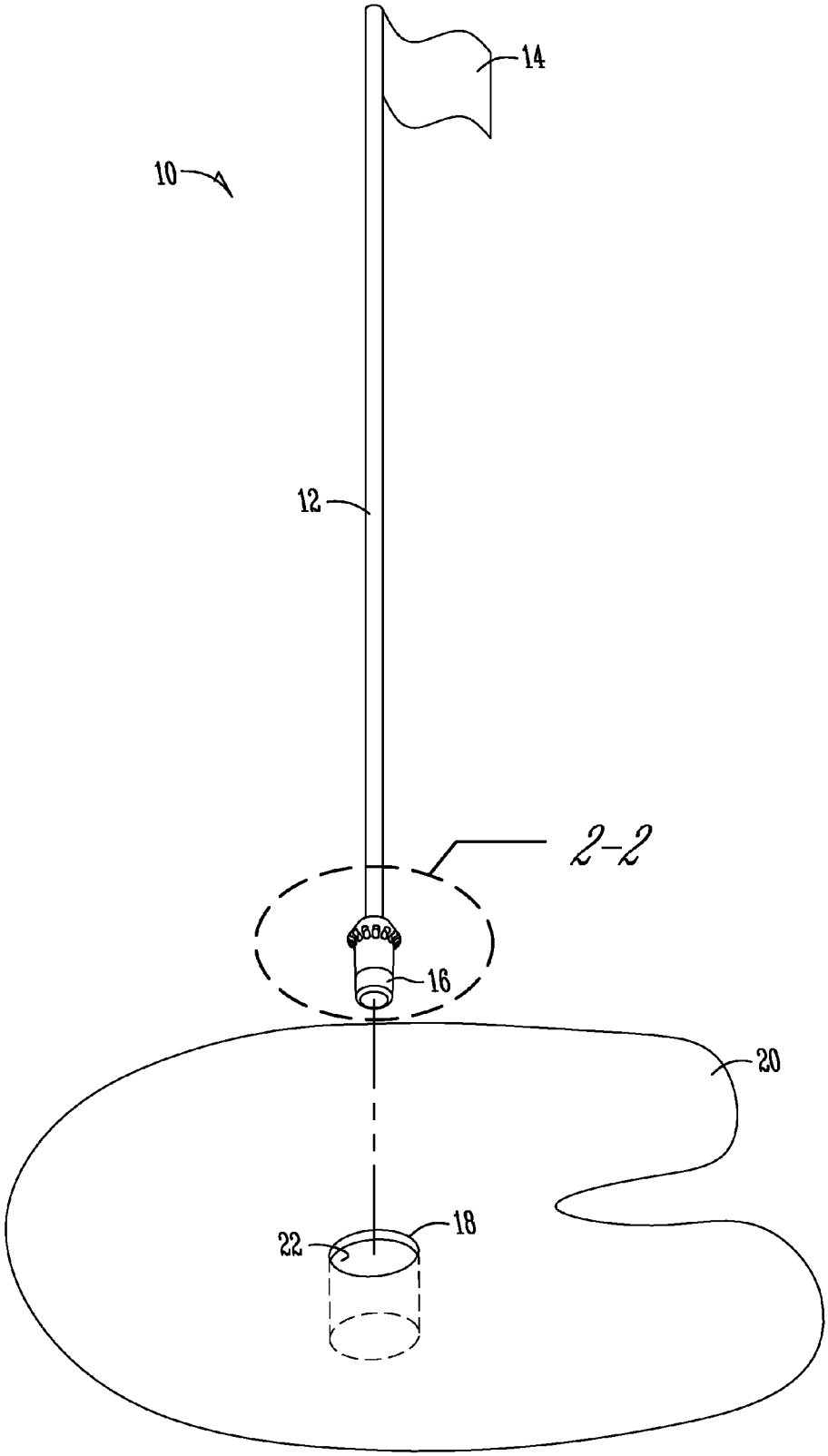
FIG. 1 is a perspective view of a golf flagstick assembly including a ferrule according to the present invention in position over a golf cup within a putting green.

FIG. 1 illustrates a flagstick assembly 10 and a golf green 20. The flagstick assembly 10 includes a flagstick body 12 having a flag 14 at a top end of the flagstick body 12 and a ferrule 16 at a lower end of the flagstick body 12. A hole 18 is provided in the green 20. A cup 22, which acts as a liner is provided within the hole 18. The flagstick assembly 10 may be selectively placed within the cup 22 to serve as a marker and visual indicator of the location of the hole 18 for golfers.

The flagstick body 12 is an elongated member commonly formed from fiberglass, metal or other suitable material. Those of skill in the art will be aware of numerous materials and configurations for the flagstick body 12. The present invention should work advantageously with virtually any known configuration for the flagstick body 12. The flag 14 will typically be a cloth or nylon flag that serves as an additional visual indicator for golfers. The flag 14 is generally provided separately from the flagstick body 12 and ferrule 16. Therefore, when the application refers to a golf flagstick, it is referring to the combination of the flagstick body 12 and the ferrule 16 with or without the flag 14. The details of the ferrule 16 of the preferred embodiment will be described in more detail in regards to the following figures.

With further reference to FIG. 1, it should be understood that while the primary use of the flagstick assembly 10 will be within a cup 22 provided in a green 20. It is also intended that the flagstick assembly 10 may also be used as a marker on a practice range, a practice green, or other known uses.

Figure 2:
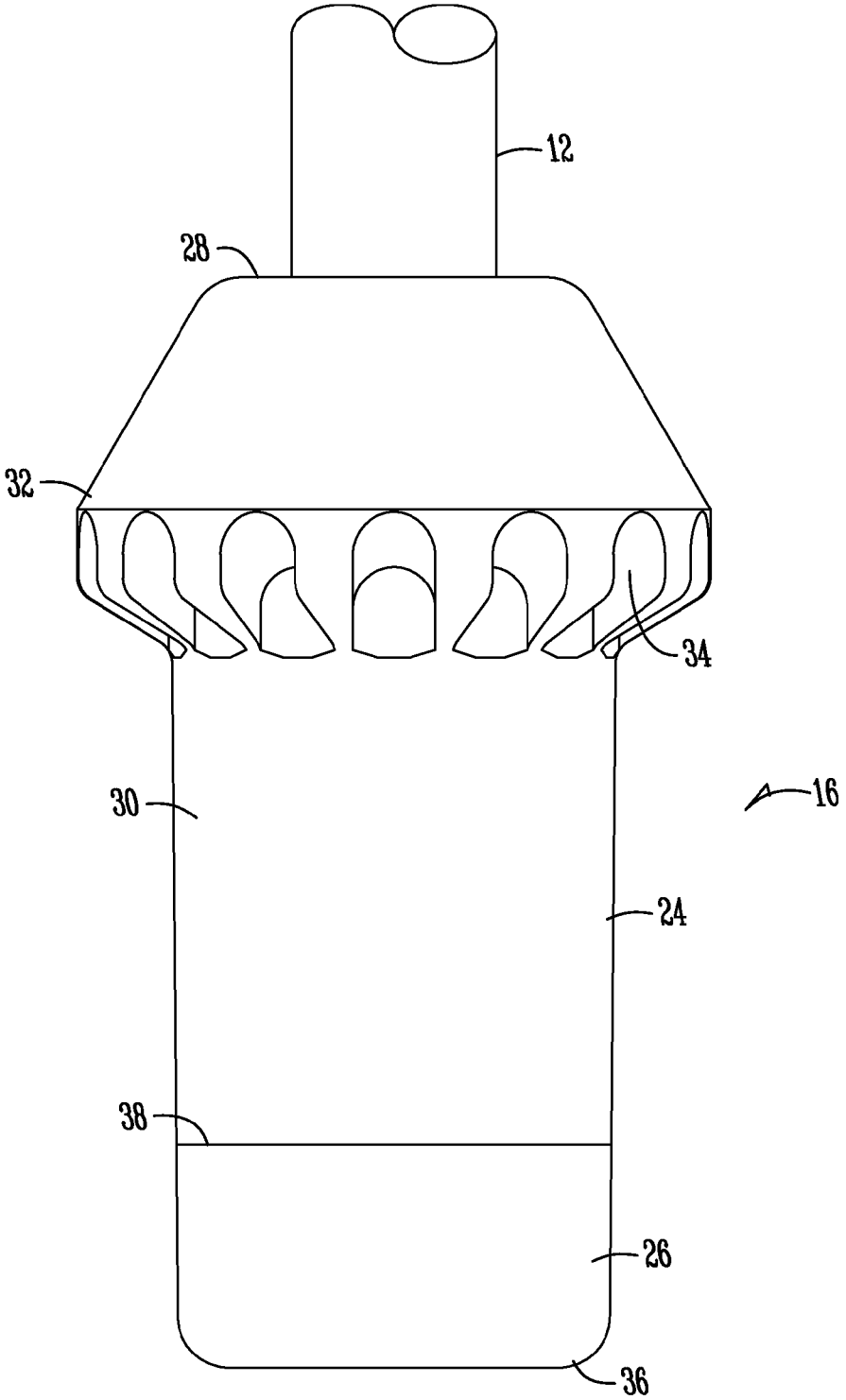
FIG. 2 is a side view of a capped metal ferrule on a golf flagstick according to one embodiment of the present invention.

FIG. 2 shows a close-up side view of the ferrule 16 from FIG. 1. The ferrule 16 includes a metal ferrule body 24 and a cap 26. The ferrule body 24 has a first end 28 that is connected with the flagstick body 12. The cap 26 is provided at an opposite end of the ferrule body 24 from the flagstick body 12. The ferrule body 24 includes a generally cylindrical barrel portion 30 and an upper retaining lip portion 32. In use, the cap 26 and barrel portion 30 are inserted into the socket portion of a golf cup and the retaining lip 30 rests on an outer structure surrounding the socket to prevent the ferrule 16 from sliding completely within the socket (see FIG. 4B). In the embodiment shown in FIG. 2, the retaining lip 32 includes grooves 34 that can be used to engage fins are provided around the socket of the cup to prevent the flagstick assembly 10 from rotating within the cup. The grooves 34 are not necessary for the present invention, and standard design ferrules that do not include such grooves may advantageously use the cap 26 described herein. Furthermore, the barrel portion 30 need not necessarily be a smooth cylinder. Drainage grooves or other features may be included on the barrel portion 30.

The cap 26 is preferably formed from a material that will not scuff, scratch, or mar, or at least is highly resistant to marring, scratching or scuffing, a golf cup. The material used to form the cap 26 should therefore be softer than the metal body 24, and preferably softer than whatever material is used to form the cup with which it be used. In one embodiment, the cap 26 is made from ultra high molecular weight (UHMW) polyethylene. Other types of plastic should also be suitable. It is also contemplated that softer metals, such as copper or brass, might be used to form the cap 26. It is also preferred to provide the cap 26 with a rounded corner 36. The cap 26 should be flush against the barrel portion 30 of the ferrule body 24 at the seam 38 to prevent water or other contaminants from coming between the cap 26 and the ferrule body 24. The barrel portion 30 and the cap 26 should preferably provide a continuous and smooth outer surface to avoid catching or snagging on the cup as the ferrule 16 is inserted into the cup socket.

Figure 3:
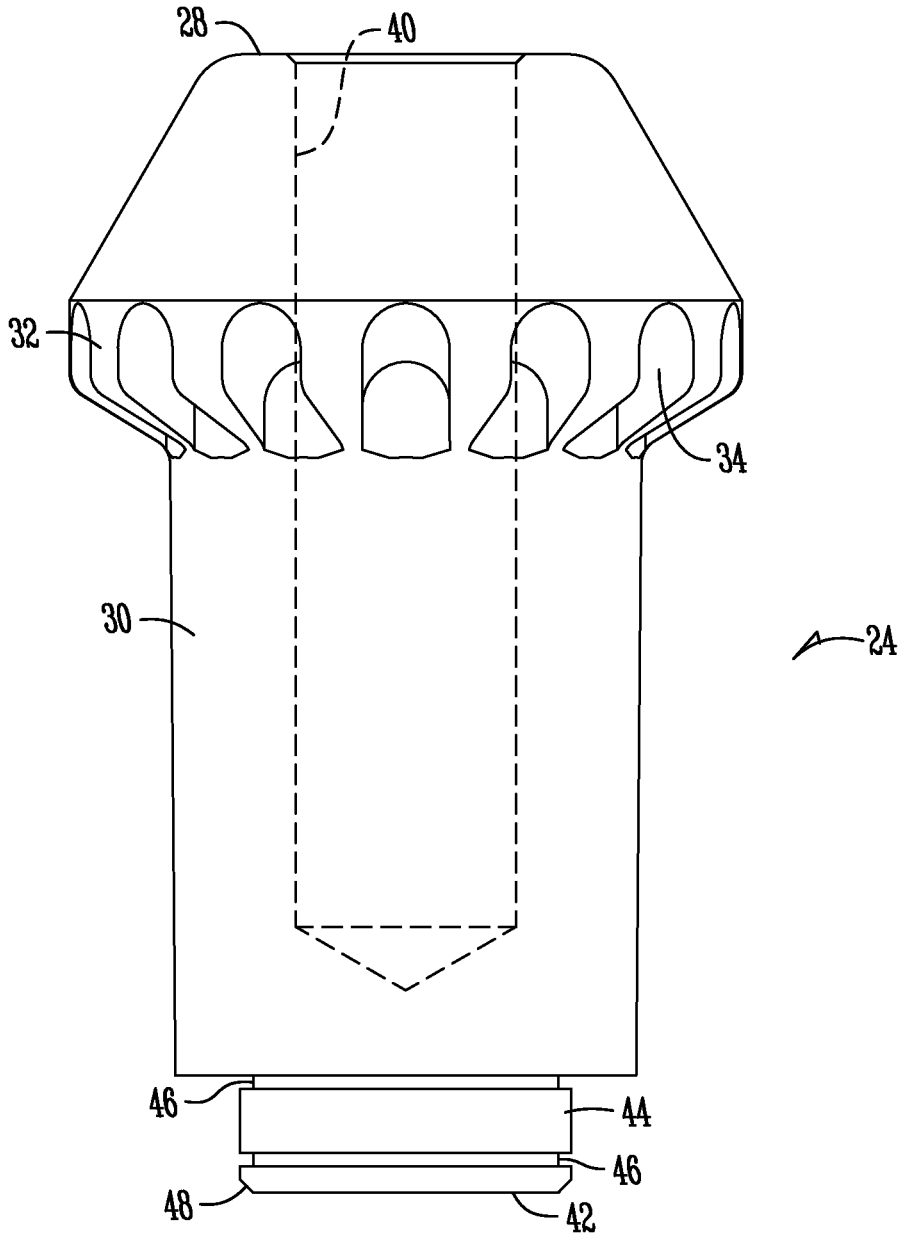
FIG. 3 is a side view of a metal ferrule body for use in forming a capped metal ferrule according to one embodiment of the present invention.

FIG. 3 shows an embodiment of the ferrule body 24 according to one embodiment of the present invention. The ferrule body 24 is generally formed from a single piece of material. Preferably, the material will be a hard metal, such as cast aluminum. The ferrule body 24 is generally solid with a passage 40 formed through the top end 28 for receiving a portion of the flagstick body 12 to attach the ferrule body 24 to the flagstick body 12. The passage 40 may be threaded so that the flagstick body 12 can be attached by screwing the ferrule body 24 onto the flagstick body 12. Alternatively, the flagstick body 12 may be retained within the passage 40 by friction fit, adhesive, pins, crimping, or other known mechanisms. A second end 42 of the ferrule body 24 is adapted for being covered by the cap 26 (not shown in FIG. 3). The second end 42 includes a projection 44 that has a smaller diameter than that of the barrel portion 30 from which the projection 44 extends. The projection 44 includes circumferential grooves 46 that act as retaining structures to help hold the cap in engagement with the ferrule body 24. As an alternative, or in addition to, the circumferential grooves 46, other retaining structures such as vertical or horizontal ribs, vertical grooves, threads, or other projections, could be provided on the projection 44 to help maintain the cap firmly in position in engagement with the ferrule body 24. The lower rim 48 of the projection 44 may be chamfered. According to one embodiment, the barrel portion 30 of the ferrule body 24 will have a diameter of about one inch, and the projection portion 44 will have a diameter of about three-fourths of one inch, such that the cap will have a thickness of about one-eighth of an inch around the sides. The exact dimensions are not critical, and may be varied while still retaining the advantages of the present invention.

Figure 4A:
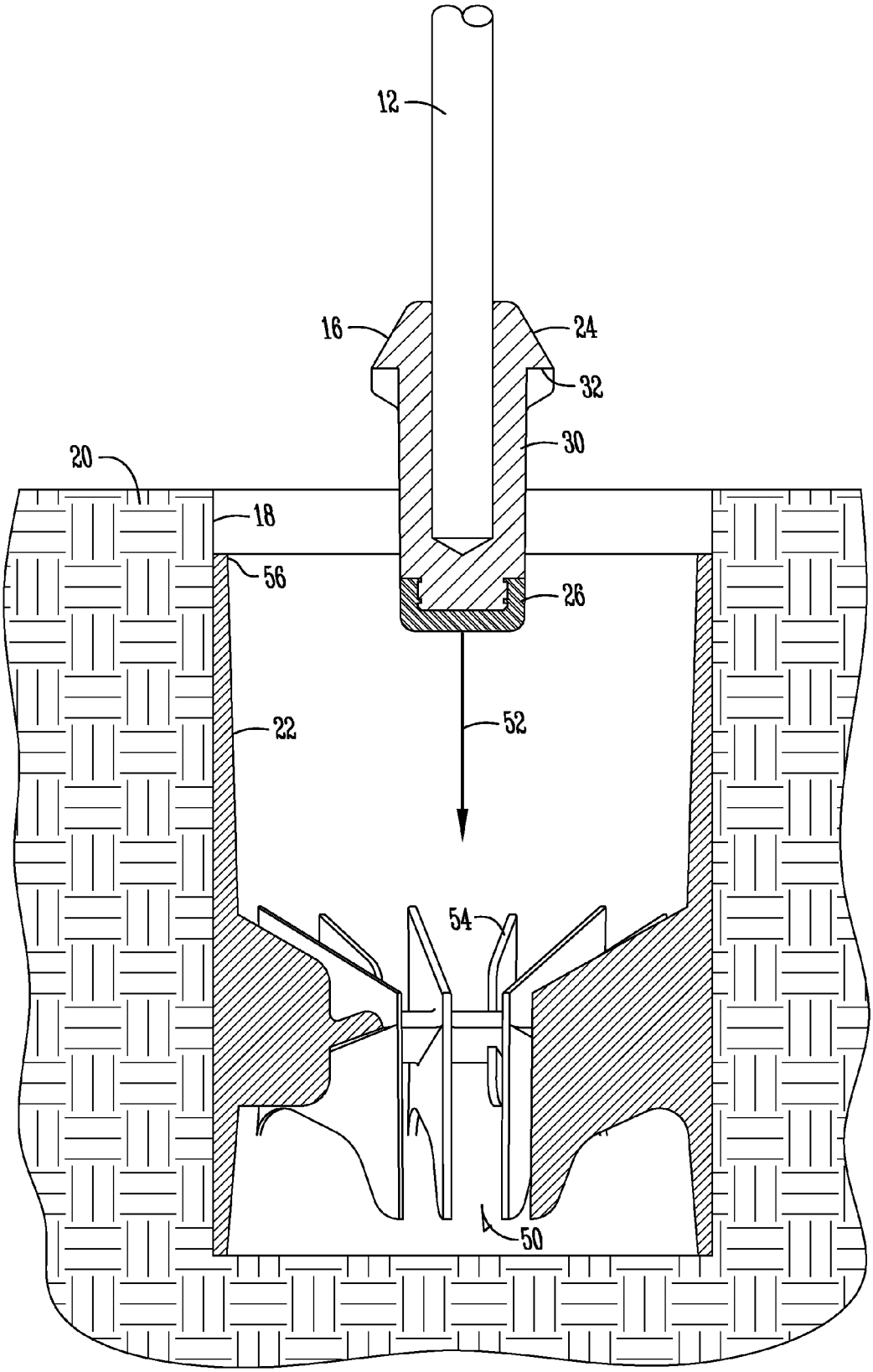
FIG. 4A is a cross-sectional view of a golf cup within a golf green showing the lower portion of a flagstick assembly ready for insertion within a socket within the cup.
Figure 4B:
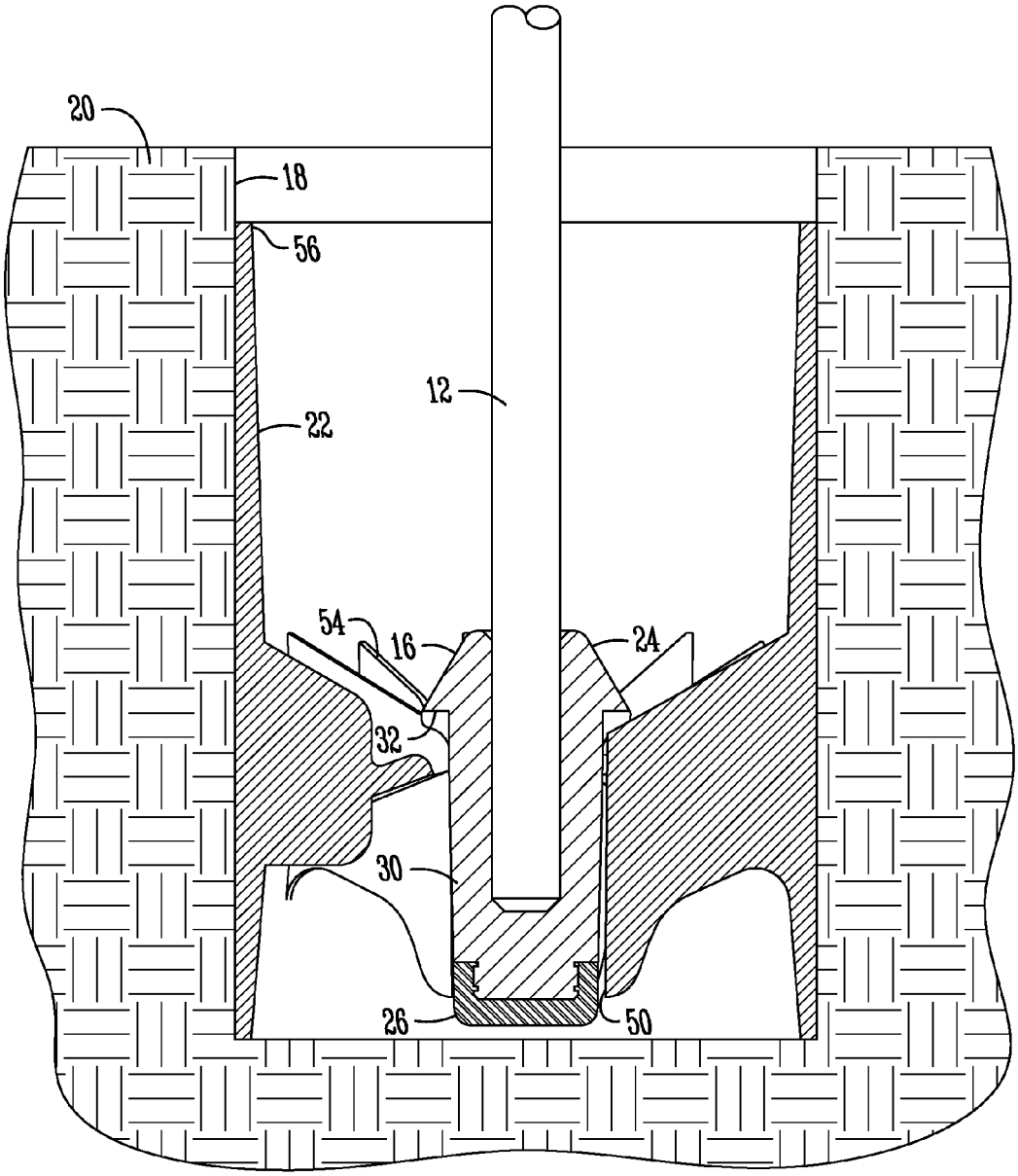
FIG. 4B is a cross-sectional view of a golf cup within a golf green showing the lower portion of a flagstick assembly inserted within the socket of the cup.

FIGS. 4A and 4B illustrate a ferrule 16 and flagstick body 12 according to one embodiment of the present invention being inserted into a socket 50 formed in the lower center portion of a cup 22 that has been provided within a hole 18 cut into a putting green 20. In FIG. 4A, the ferrule 16 is being placed into the cup 22 by moving it downwardly in the direction of arrow 52 toward the socket 50. In FIG. 4B, the ferrule 16 has been fully received within the socket 50 with the retaining lip 32 of the ferrule body 24 engaging the bottom structure 54 of the cup 22. In the embodiment of the cup 22 shown in FIGS. 4A and 4B, the bottom portion 54 of the cup 22 is formed by a plurality of ribs. This design is described in more detail in U.S. Pat. No. 7,033,280, which is hereby incorporated by reference. Other standard configurations for a golf cup may be used and be well-known to those of ordinary skill in the art. As seen in FIG. 4B, the retaining lip 32 prevents the ferrule 16 from passing completely into the socket 50, and maintains the flagstick at a desired position within the cup 22. As also seen in FIG. 4B, the barrel portion 30 and cap 26 of the ferrule 16 may be tapered slightly to be narrower at the bottom than at the top. This is helpful in preventing the ferrule 16 from becoming stuck within the socket 50, especially when there is said, dirt, or water stuck between the ferrule 16 and the sides of the socket 50.

As the flagstick and ferrule 16 are being inserted into and removed from the cup 22, it is not uncommon for the bottom portion of the ferrule 16 to strike the cup 22. This is especially true at the bottom structure 54, especially in the vicinity of the socket 50 and along the upper rim 56 of the cup 22. In the ferrule 16 of the present invention that includes the cap 26, cap 26 is the portion of the ferrule 16 that will generally be brought into contact with the bottom structure 54 and the area around the top rim 56 of cup 22. Because cap 26 is preferably made of a material that is softer than the cup 22, in any event softer than the metal of the barrel body 30, it is less likely to mar or otherwise damage the cup 22 when it strikes the cup 22 during seating and unseating of the ferrule 16 within the socket 50. Preferably, the cap 26 will cover the entire bottom surface of the ferrule 16 as well as extending a small distance of the sides of the ferrule 16. According to one embodiment, the cap 26 extends about half an inch below the most exposed surface of the ferrule body barrel portion 30. The metal barrel body portion 30 is more resistant to getting stuck within the socket 50 than a similarly shaped barrel body portion made out of plastic, because sand, dirt, and other contaminants do not adhere to the metal as readily as to plastic, and because it is harder and less likely to allow the contaminants to become embedded. The cap 26 protects the cup 22 from being marred or otherwise damaged as the cup 22 is struck by the insertion and removal of the ferrule 16 from the socket 50.

The drawings show a ferrule 16 that has a generally smooth cylindrical body 24. However, the body 24 may also include grooves or other features. The cap 26 may be shaped to match the shape and features of the ferrule body 24.

Figure 5:
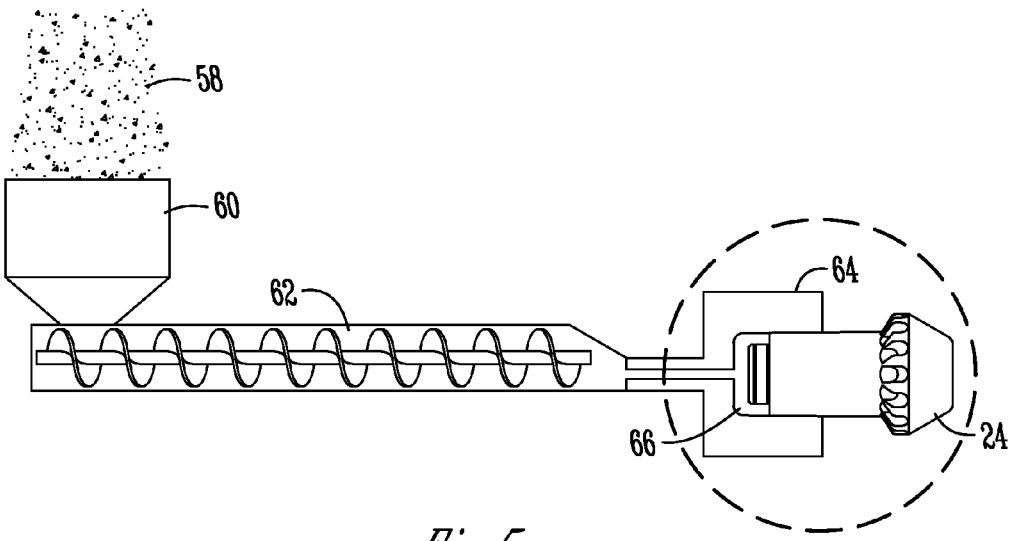
FIG. 5 is a schematic representation of an injection molding system used for making a plastic-capped metal ferrule according to one embodiment of the present invention.

FIG. 5 is a schematic diagram illustrating one mechanism for making a plastic-capped metal ferrule according to one embodiment of the present invention. The mechanism is not drawn to scale, but instead is intended as merely a diagram to indicate the various components. The components are those that are used in a standard over molding process that forms the cap 26 on the ferrule body 24. Raw plastic 58 is provided to a hopper 60 that melts the plastic into a molten form and provides it to auger 62. Auger 62 provides the molten plastic to a mold 64 that includes mold cavity 66. A portion of the ferrule body 24 is inserted into the mold cavity 66, such that the cap can be over molded onto the end of the body 24.

Figure 6:
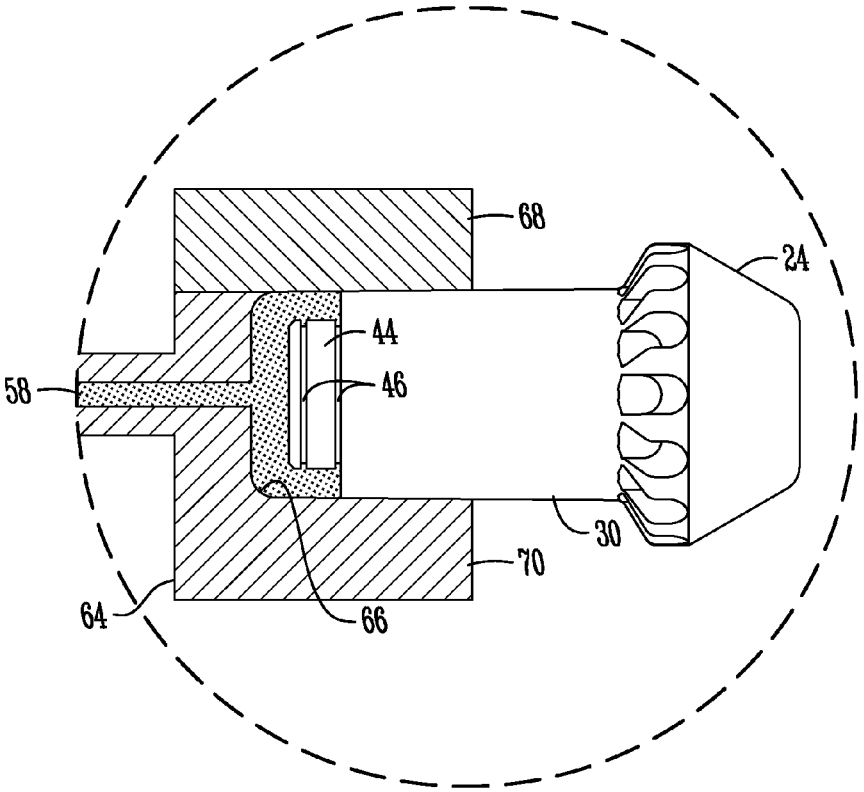
FIG. 6 is a detailed close-up of a schematic rendering of a plastic injection mold used for making a plastic-capped metal ferrule according to one embodiment of the present invention.

FIG. 6 shows a detail view of the mold 64 with a ferrule body 24 inserted into the mold cavity 66. As shown, the mold 64 may include two mold portions 68 and 70 that can be brought together to form the mold cavity 66 and at least partially separated to allow removal of a finished ferrule 16.

Figure 7:
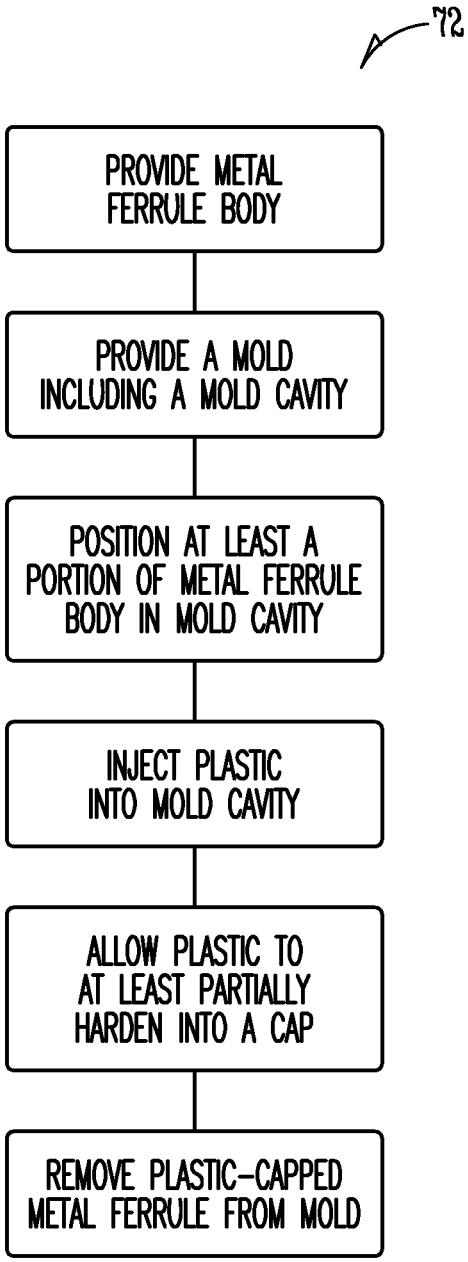
FIG. 7 is a diagram illustrating the steps used to make a plastic-capped metal ferrule according to one embodiment of the present invention.

FIG. 7 is a diagram illustrating the steps to be followed to make a plastic-capped metal ferrule 16 according to one embodiment of the present invention utilizing the components shown in FIGS. 5 and 6. According to this method, a metal ferrule body 24 is provided and at least a portion of the ferrule body is positioned within the mold cavity 66 in the mold 64. Plastic 58 is injected into the mold cavity, which covers the end projection 44 extending from the barrel portion 30 of the ferrule body 24. In particular, the mold and plastic 58 fills in all the space of the mold including within the grooves 46 formed on the projection 44. The mold and plastic is allowed to at least partially harden in order to form the cap 26 on the end of the body 24. The plastic-capped ferrule 16 is then removed from the ferrule cavity 66. Those of skill in the art will recognize various structures for forming the mold and mold cavity 66 and for injecting the plastic into the mold cavity 66, as well as for removing the finished part from the mold cavity 66.

As an alternative, the cap 26 can be formed as a separate injection molded part. The cap 26 may then be applied to the ferrule body 24 by snapping the cap 26 into place on the projection 44. Preferably, the cap 26 will be formed with projections that engage the grooves 46, or other retaining structure provided on the projection 44 to help maintain the cap 26 in place on the end of the ferrule body 24. The cap 26 may be maintained on the projection 44 by friction fit, adhesive, or similar known mechanisms. It is contemplated that the cap 26 may wear more quickly than the metal body 24. Accordingly, this alternative embodiment with the separate snap on cap may permit replacement of a worn cap 26 with a new cap 26. In the over molded embodiment of the ferrule 16, it will be necessary to replace the entire ferrule 16 on the flagstick body 12 in case the cap 26 becomes worn. Therefore, in the over molded version, it will be especially desirable to make the connection between the ferrule 16 and the flagstick body 12 removable, such as a threaded connection.

As a further embodiment, the cap 26 may be formed from a soft metal, such as brass, copper, or the like. In such a case, the cap 26 may be attached to body 24 by brazing, crimping, set-screws, or other known mechanisms.

A preferred embodiment of the present invention has been set forth above. It should be understood by one of ordinary skill in the art that modifications may be made in many of the details discussed above, especially matters of shape, size, and arrangement of parts. Such modifications are deemed to be within the scope of the present invention, which is to be limited only by the broad general meaning of the terms in which the appended claims are expressed.

What is claimed is:

1. A ferrule for a golf flagstick comprising:

a generally cylindrical metal body shaped for insertion within a socket of a cup in a golf green, said body having a first end for attachment with a flagstick body and a second end opposite from the first end for insertion into the socket; and a cap covering at least a portion of the second end of the metal body wherein the cap is softer than the metal body;

wherein the cap having an outer diameter substantially equal to a barrel portion of the ferrule body; and wherein the second end of the metal body includes a projection comprising a diameter that is less than the diameter of the first end and further comprising one or more indents on the external of the second end for interacting with the cap to aid in holding the cap in place.

2. The ferrule of claim 1, wherein the cap is made of plastic that is over molded on to the metal body.

3. The ferrule of claim 1, wherein the one or more indents of the second end comprise a retaining structure in engagement with the cap to hold the cap in place against the metal body.

4. The ferrule of claim 1, wherein the one or more indents of the second end of the metal body comprise at least one circumferential groove.

5. The ferrule of claim 1, wherein a material used to form the cap has a hardness less than that of a golf cup.

6. The ferrule of claim 5, wherein the material is ultra high molecular weight polyethylene.

7. The ferrule of claim 1, further comprising a passage formed in the first end of the metal body for receipt of a flagstick body.

8. The ferrule of claim 1, wherein the metal body is formed from aluminum.

9. The ferrule of claim 8, wherein the cap is formed from a metal that is softer than aluminum.

10. A golf flagstick comprising:

a flagstick body;

a metal ferrule body shaped for insertion within a cup in a golf green, the metal ferrule body having a first end and a second end opposite from the first end, the first end of the metal ferrule body being connected to the flagstick body;

a cap covering and protecting at least a portion of the second end of the metal body;

wherein the cap is softer than the metal ferrule body;

wherein the cap having an outer diameter substantially equal to a barrel portion of the ferrule body; and wherein the second end of the metal body includes a projection comprising a diameter that is less than the diameter of the first end and further comprising one or more indents on the external of the second end for interacting with the cap to aid in holding the cap in place.

11. The golf flagstick of claim 10, wherein the cap is made of plastic over molded on to the metal ferrule body and in communication with the one or more indents.

12. The golf flagstick of claim 11, wherein the one or more indents of the second end comprise a retaining structure in engagement with the plastic cap to hold the plastic cap in place against the metal ferrule body.

13. The golf flagstick of claim 11, wherein the one or more indents of the second end of the metal body comprise at least one circumferential groove.

14. The golf flagstick of claim 10, wherein a material used to form the cap has a hardness less than that of a golf cup.

15. The golf flagstick of claim 14, wherein the material is ultra high molecular weight polyethylene.

16. The golf flagstick of claim 10, further comprising a passage formed in the first end of the metal body for receipt of a flagstick body.

17. The golf flagstick of claim 10, wherein the metal ferrule body is formed from aluminum.

18. The golf flagstick of claim 17, wherein the cap is formed from a metal softer than aluminum.

* * * * *